United States Patent [19]

Kalkowski

[11] 4,427,127

[45] Jan. 24, 1984

[54] FLOATING DECK SUPPORT APPARATUS

[75] Inventor: Dean J. Kalkowski, Saddle Brook, N.J.

[73] Assignee: Mayflower Vapor Seal Corp., Little Ferry, N.J.

[21] Appl. No.: 393,453

[22] Filed: Jun. 29, 1982

[51] Int. Cl.[3] ..... B65D 88/34; B65D 88/40

[52] U.S. Cl. ..... 220/218; 220/220; 267/139

[58] Field of Search ..... 267/139, 150, 140; 220/216–227; 248/580, 615, 644; 403/225, 153, 132; 405/210, 219

[56] References Cited

U.S. PATENT DOCUMENTS

| | | | |
|---|---|---|---|
| 2,974,822 | 3/1961 | Trimble | 220/218 |
| 3,563,525 | 2/1971 | Narabu | 267/140 |
| 3,904,300 | 9/1975 | Hetmann | 403/132 X |
| 4,244,487 | 1/1981 | Kern | 220/216 |

*Primary Examiner*—Allan N. Shoap
*Assistant Examiner*—Robert Petrik

[57] ABSTRACT

A cover adapted to float on the surface of liquid in a storage tank employs a deck and first and second generally horizontal elongated pontoons disposed essentially along a common axis of symmetry. The pontoons are adapted to float support the deck on the surface. A vertical hollow member open at top and bottom is disposed between adjacent ends of the adjacent pontoons.

First and second devices each resiliently and flexibly secure the end of the corresponding one of the pontoons adjacent the member to the member. The first and second devices are disposed on opposite sides of the member.

A vertical leg extends downwardly through the hollow member and is secured thereto.

8 Claims, 3 Drawing Figures

FLOATING DECK SUPPORT APPARATUS

BACKGROUND OF THE INVENTION

In order to minimize evaporation losses of liquid in liquid storage tanks, it is known that internal covers of aluminum or steel can be employed. These covers float on the surface of the liquid and have peripheral seals which engages the inner walls of the tanks in which they are disposed.

Such a cover consists of a deck resting upon pontoons which float in the liquid and float support the deck. Adjacent pontoons, horizontally elongated, are disposed end to end along the direction of elongation. Downwardly depending legs disposed between adjacent ends of adjacent pontoons are secured thereto, these legs having the function of supporting the deck and pontoons above the bottom of the tank when the liquid stored therein is removed.

Initially, the legs were welded or otherwise rigidly secured to the pontoons since this arrangement enhanced the strength of the structure. However, it was discovered that, under certain conditions, internal turbulence in the liquid could cause the buildup of stresses which would in turn cause the deck to flex to an extent at which the pontoon ends secured to the legs could break away from the legs and cause the entire structure to fail.

One solution to this problem shown in U.S. Pat. No. 4,244,487 was to allow one end of a first pontoon to remain rigidly secured to a leg while connecting the end of a second pontoon previously secured rigidly to this leg to the leg in such manner that the second pontoon could pivot with respect to the longitudinal axis of the first pontoon when the deck is flexed.

This solution, however, while it does minimize the reaction of the deck, legs and pontoons to internal turbulence, does not fully eliminate the reaction whereby the deck can still deform and break under conditions of extreme turbulence.

The present invention is directed toward a new type of leg-pontoon connection which essentially eliminates the risk that the deck will deform and break subjected to extreme turbulence.

SUMMARY OF THE INVENTION

In accordance with the principles of the invention, first and second generally horizontal elongated pontoons are disposed along a common axis of elongation and are adopted to float in the liquid contained in a storage tank to float support a deck resting thereon and floating on the surface of the liquid.

A vertical hollow member open at top and bottom is disposed between the pontoons. A vertical sleeve extends downwardly through the hollow interior of the member. A vertical leg extends downwardly through the sleeve.

Each of first and second means resiliently and flexibly secures the end of the corresponding one of the first and second pontoons adjacent the member to the member. The first and second means are disposed on opposite sides of the member. This arrangement of pontoons and legs, sleeves and members is used repeatedly so that the entire deck can be supported.

Since each pontoon is resiliently and flexibly secured to its leg, each pontoon can pivot with respect to its leg and with respect to the other pontoon whereby the entire structure can flex as necessary without causing deformation and breakage and yet the structure has sufficient strength to function in the desired manner to minimize evaporation losses.

DETAILED DESCRIPTION OF PREFERRED EMBODIMENTS

Figure 1:
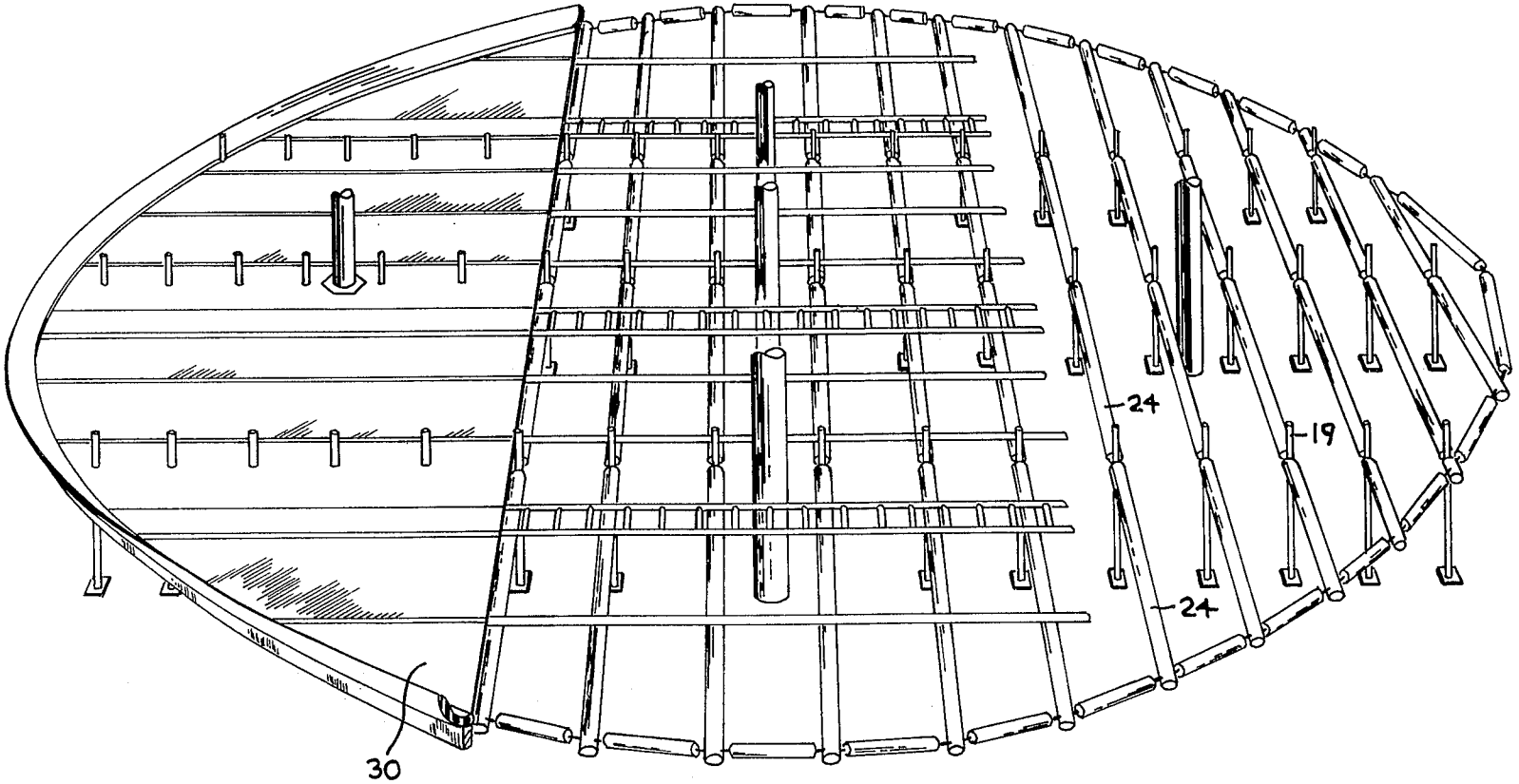
FIG. 1 is a partially cut away perspective view of the invention in use.
Figure 2:
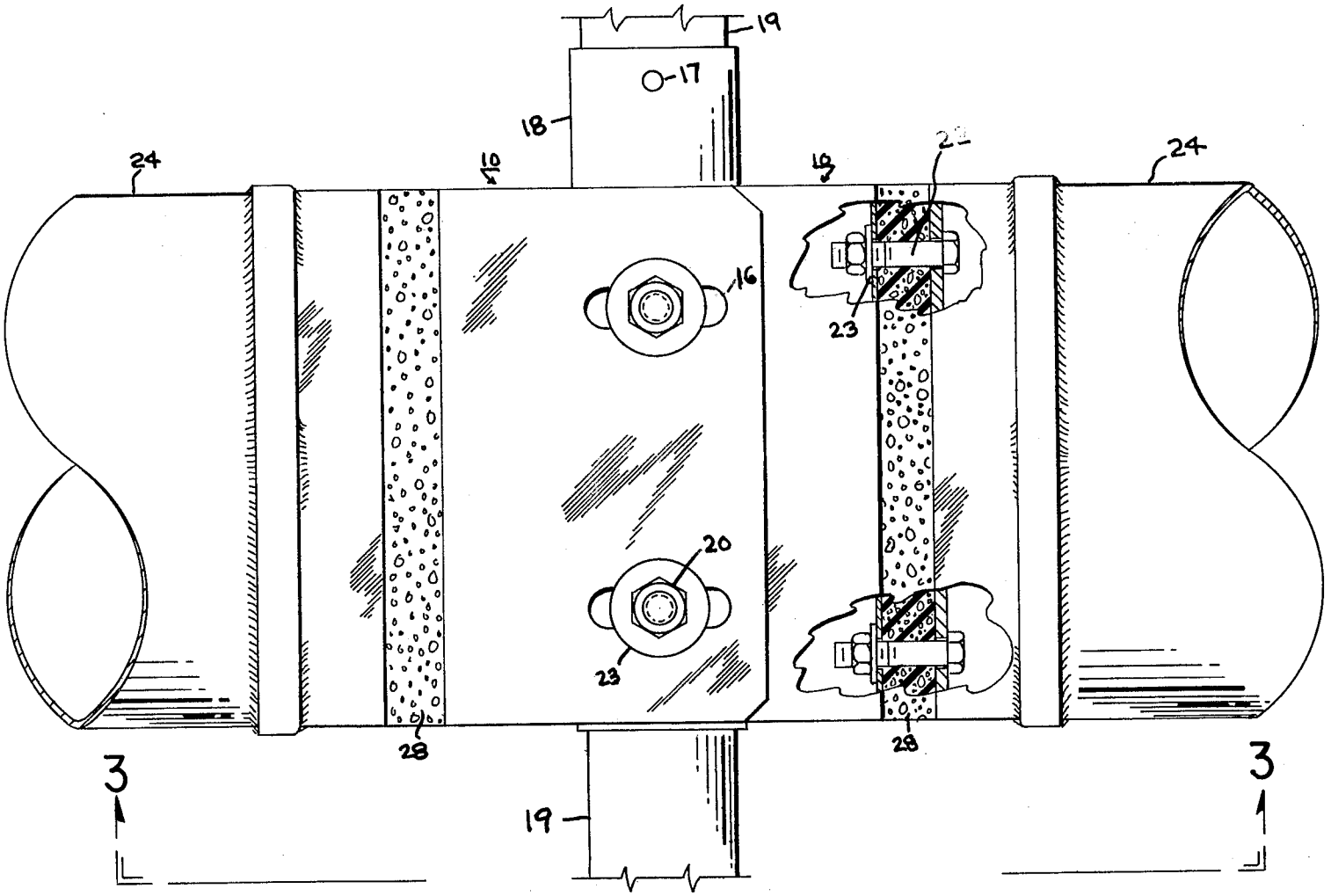
FIGS. 2 and 3 are different detail views illustrating the interconnection of legs, pontoons and members.
Figure 3:
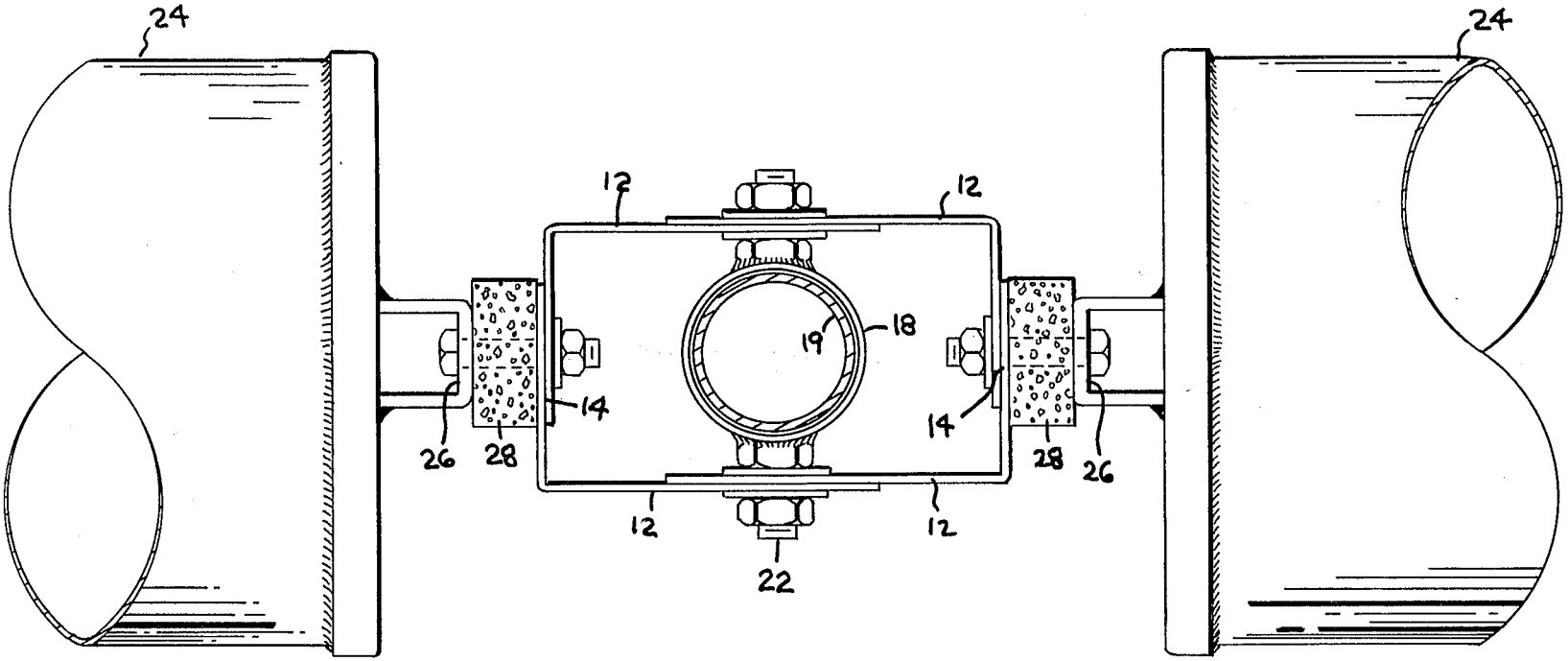

Referring now to FIGS. 1–3, a vertical hollow member open at top and bottom and having in horizontal cross section the shape of a rectangle is formed by interconnection of two vertical elements 10. Each element 10 in horizontal cross section has the shape of a U. Each element has two parallel vertical plates 12 interconnected by an integral outer vertical plate 14. Each plate 12 has upper and lower horizontally elongated slots 16. Each plate of one element is in adjacent abutting relationship with the slots at least partially aligned.

A vertical hollow sleeve 18 having a circular cross section extends downwardly between the elements and has integral horizontal bolts 22 which extend through the partially aligned slots. A vertical leg 19 can extend through sleeve 18 and secured thereto by a keeper extending through opening 17. Nuts 20 engage the bolts to secure the leg and the elements together. Washers 23 are disposed between nuts and plates.

First and second horizontally elongated hollow float pontoons 24 have adjacent ends with flat surfaces 26, each end being adjacent a corresponding vertical plate 14 and having its surface parallel thereto. By means of nuts 20, washers 23 and bolts 22 each end surface adjacent a corresponding one of plates 14 is secured thereto with a rectangular block 28 of flexible and resilient material tightly clamped therebetween. This arrangement allows each pontoon which is aligned with the common direction of elongation to pivot under stress and return to original position when the stress is removed.

The block must be made of a material which is chemically inert with respect to the fluid in which it is inserted. Typically, the liquid is a hydrocarbon such as oil or gasoline and the block is composed of Buna-N or polyurethane.

The use of the slots 16 enables the relative positions of the pontoons and legs to be adjusted initially as desired and to be readjusted from time to time as necessary. The pontoons are disposed on opposite sides of the leg as shown.

The arrangement of pontoons, elements and legs is repeated as necessary to support aluminum deck 30 in a tank in such manner as to float on the surface of a liquid.

The bottom of the leg can be notched to permit drainage.

Collars can encircle the legs above and below the sleeve. The collars can determine deck height at assembly and can allow the leg to slide down to prevent hitting the tank top.

What is claimed is:

1. For use with a deck adapted to float on the surface of liquid in a storage tank, the combination comprising:

first and second generally horizontal elongated pontoons disposed along a common axis of elongation and adapted to float support said deck on said surface;

a vertical hollow member open at top and bottom disposed between said pontoons, said member in horizontal cross section having a generally rectangular shape;

a vertical sleeve extending downwardly through the hollow interior of said member and secured thereto; and first and second means, each of the first and second means resiliently and flexibly securing the end of the corresponding one of the first and second pontoons adjacent said member to said member, the first and second means being disposed on opposite sides of said member.

2. The combination of claim 1 wherein each adjacent end has a surface parallel to the surface of the member to which it is connected by the corresponding one of said means.

3. The combination of claim 2 wherein each means includes a rectangular block of flexible resilient material.

4. The combination of claim 3 wherein said material is chemically inert with respect to the liquid in the tank.

5. The combination of claim 4 wherein said member has two generally vertical inerconnected elements which can be adjusted in relative position and then locked in said position.

6. The combination of claim 5 wherein each element in horizontal cross section has the shape of a U, each element having two spaced parallel plates interconnected by an integral transverse vertical outer plate, each means being connected to a corresponding outer plate of a corresponding element.

7. The combination of claim 6 wherein the parallel plates have spaced horizontally elongated holes, each parallel plate of one element being disposed adjacent a corresponding parallel plate of the other element with their holes being at least partially coincident, plate securing devices being disposed within each pair of partially coincident holes to rigidly interconnect said elements together.

8. A cover adapted to float on the surface of liquid in a storage tank and comprising:

a deck;

first and second generally horizontal elongated pontoons disposed essentially along a common axis of elongation and adapted to float support said deck on said surface;

a vertical hollow member open at top and bottom disposed between said pontoons, said member in horizontal cross section having a generally rectangular shape;

first means resiliently and flexibly securing the end of the first pontoon adjacent said member to said member;

second means resiliently and flexibly securing the end of the second pontoon adjacent said member to said member, the first and second means being disposed on opposite sides of said member;

a vertical sleeve extending downwardly through said hollow member and secured thereto; and a vertical leg extending downwardly through the sleeve.

* * * * *